US012629586B2

(12) United States Patent
Dante

(10) Patent No.: US 12,629,586 B2
(45) Date of Patent: May 19, 2026

(54) METHOD FOR CHANGING A VISUAL DISPLAY COMPOSED OF FRAGMENTS IN A VISIBLE GRID

(71) Applicant: Andreas Dante, Böblingen (DE)

(72) Inventor: Andreas Dante, Böblingen (DE)

( * ) Notice: Subject to any disclaimer, the term of this patent is extended or adjusted under 35 U.S.C. 154(b) by 262 days.

(21) Appl. No.: 18/617,561

(22) Filed: Mar. 26, 2024

(65) Prior Publication Data

US 2024/0325872 A1 Oct. 3, 2024

(30) Foreign Application Priority Data

Mar. 28, 2023 (DE) ..... 102023107872.0

(51) Int. Cl.
*G06Q 20/00* (2012.01)
*A63F 9/06* (2006.01)
*A63F 9/24* (2006.01)

(52) U.S. Cl.
CPC ..... *A63F 9/0612* (2013.01); *A63F 9/24* (2013.01); *A63F 2009/2457* (2013.01)

(58) Field of Classification Search
CPC .. A63F 9/0612; A63F 9/24; A63F 2009/2457; G06T 11/00
USPC ..... 705/16, 21, 59; 380/44
See application file for complete search history.

(56) References Cited

U.S. PATENT DOCUMENTS

| | | | | |
|---|---|---|---|---|
| 3,656,248 | A | 4/1972 | Echter | |
| 4,863,172 | A | 9/1989 | Rosenwinkel et al. | |
| 5,643,085 | A | 7/1997 | Aityan et al. | |
| 5,944,605 | A | 8/1999 | Pajitnov | |
| 9,144,190 | B2 | 9/2015 | Henry et al. | |
| 11,000,768 | B2 | 5/2021 | Orak | |
| 2009/0239646 | A1 | 9/2009 | Yoshizawa | |
| 2014/0128159 | A1 | 5/2014 | Knutsson | |
| 2016/0220898 | A1* | 8/2016 | Nyblom | A63F 13/35 |

FOREIGN PATENT DOCUMENTS

| | | | |
|---|---|---|---|
| CA | 1186351 | A | 4/1985 |
| DE | P0026354 | | 11/1951 |
| EP | 0067805 | A2 | 12/1982 |
| JP | 2021069925 | A | 5/2021 |
| KR | 20210061180 | A | 5/2021 |
| WO | 8402851 | A1 | 8/1984 |

* cited by examiner

*Primary Examiner* — Dante Ravetti
(74) *Attorney, Agent, or Firm* — Smartpat PLC

(57) ABSTRACT

A method for the change of a visual depiction (D) composed of fragments (Fa-Fl) of the same or unequal size can be implemented in form of a sliding puzzle. The fragments (Fa-Fl) contain content that is displayed on a display of a screen and is visually perceptible to the user. The depiction (D) is divided into a visible grid (G) with cells (F) on the display which is formed from rows (R) arranged one above the other and columns (S) arranged next to one another. The method contains instructions, by means of which a direct or indirect movement of a fragment (Fa-Fl) towards the outside area (B', B") of the grid (G) or towards a gap (A, A', A") causes the content of this fragment (Fa-Fl) by a corresponding shift of the content of its cached twin fragment (Za-Zc, Ze-Zh, Zj, Zk) or multiple twin fragment (MZa-MZe, MZh, MZi) is displayed in a defined cell (F).

4 Claims, 7 Drawing Sheets

METHOD FOR CHANGING A VISUAL DISPLAY COMPOSED OF FRAGMENTS IN A VISIBLE GRID

CROSS-REFERENCE TO RELATED APPLICATION

This application claims the benefit of German Patent Application DE 102023107872.0, filed on Mar. 28, 2023, the content of which is incorporated in its entirety.

TECHNICAL FIELD

The present disclosure relates to a method for changing a visual depiction made of fragments in a grid that is visible to a user, and in particular to a sliding puzzle.

BACKGROUND

U.S. Pat. No. 5,944,605 describes a method for the change of a visual depiction composed of fragments, in which the visual representation is divided into a grid with cells on a display formed from rows arranged one above the other and columns arranged next to one another. The software is designed to display an initial configuration of the fragments within the grid on the display, the fragments having content that is displayed. Upon receiving input from the user, a selected fragment is moved to a cell at a different position within the grid.

U.S. Pat. No. 4,863,172 describes a method in which, by moving a fragment in a row or in a column, all of the fragments in the respective rows or columns affected by the movement of the fragment moved by the user are jointly moved with the selected fragment in the row or column in the direction of movement.

A disadvantage of these methods, and all other methods known from the prior art, is that the display of individual fragments on a display of a screen with a defined resolution can be limited both with regard to their individual arrangement and with regard to the display quality. Another significant disadvantage of known methods with regard to the display quality is, in particular, that the fragments to be displayed within the display are not always visible during a rearrangement.

Publications CA 1186 351, WO 84/02851, EP 0 067 805, DE P 26 354 D AZ, U.S. Pat. No. 3,656,248, US 2009/0 239 646 and U.S. Pat. No. 5,643,085 teach different methods for the change of a visual depiction composed of fragments.

US 2016/0 220 898 describes a method for controlling a user interface in the context of a computer-implemented game of a matching type (switcher, clicker or linker), in which tiles are rendered at the location of the removed game elements with a background appearance when the removed game elements are replaced.

US 2014 0 128 159 describes a method, implemented as computer code, in which a computing device displays computer game graphics showing a game board with multiple game elements that are removed when they fit together or are replaced, and in which one or more processors are programmed so that, in order to pass a level, the player must remove a defined number of game elements of several specific collection types present on the game board in a limited number of moves.

JP 2021 069 925 shows a gaming device with a display unit with a display screen on which a plurality of objects are displayed, the gaming device having a processing unit by means of which changing the display mode of a manipulated object includes deleting the manipulated object from the display screen, wherein the processing unit displays, among the plurality of objects, an object adjacent to the deleted object in a predetermined direction to automatically move to a position of the deleted object on the display screen.

U.S. Pat. No. 11,000,768 shows a method for controlling a computer game that includes a plurality of objects displayed in a pattern on a game area, wherein when selecting objects that have at least one common property (e.g. color) with other neighboring objects the adjacent objects with one or more common properties can be removed, thereby opening rooms to the other objects and moving the displayed objects and off-screen objects in to fill the rooms.

KR 2021 0 061 180 A shows a computer program for providing a block game in which a two-dimensional array of one or more blocks is created, including at least one or more multi-blocks, the program having one or more blocks that contribute to the two-dimensional arrangement of blocks may move based on user input, wherein states of the moved block and the adjacent block are determined based on at least one attribute of the moved block or the adjacent block.

SUMMARY

The present disclosure provides a method for changing a visual depiction composed of fragments. The fragments have contents that is visually perceptible to a user on a display. The fragments are arranged in cells within a visible grid on the display. The grid is formed by rows arranged one above another and columns arranged next to one another. At least one gap is arranged within the visible grid. The at least one gap does not represent a cell. No fragment is depicted within the at least one gap, and the at least one gap cannot be moved directly or indirectly by a user input.

In particular, the method can be implemented in form of a sliding puzzle. In such an implementation, a plurality of puzzle pieces (fragments) are displayed in a grid. At least one empty space (gap) is present on the grid. The empty space cannot be moved and cannot be filled with any puzzle piece. The empty space remains in a fixed position throughout the puzzle game.

The present method allows individual and efficient display and movement of individual fragments (puzzle pieces) visible to the user on a display. The optically perceptible contents of individual fragments to be moved on the display is visible to the user at all times.

The method enables a depiction of preferably rectangular or differently shaped fragments of a two-dimensional depiction with targeted gaps that are shown on the display of a screen and preferably consist of pixels, dots, image cells or image elements and have display content. The method ensures that when the fragments are (re) arranged, all visually perceptible content of all fragments always remains visible to the viewer and no new content is added. Furthermore, the method ensures that rearrangement of the fragments is possible without omitting content. Therein, all N! (N-factorial) permutations of N fragments can be depicted as long as the number of rows or columns is even. The special feature of the disclosed method is that it can also be used if there are no fragment positions in the inner or edge area and when moved, these empty positions act in the same way as external positions.

Further objectives, features, advantages and possible applications of the method according to the invention result from the following description of exemplary embodiments based on the drawings.

DETAILED DESCRIPTION

Figure 1:
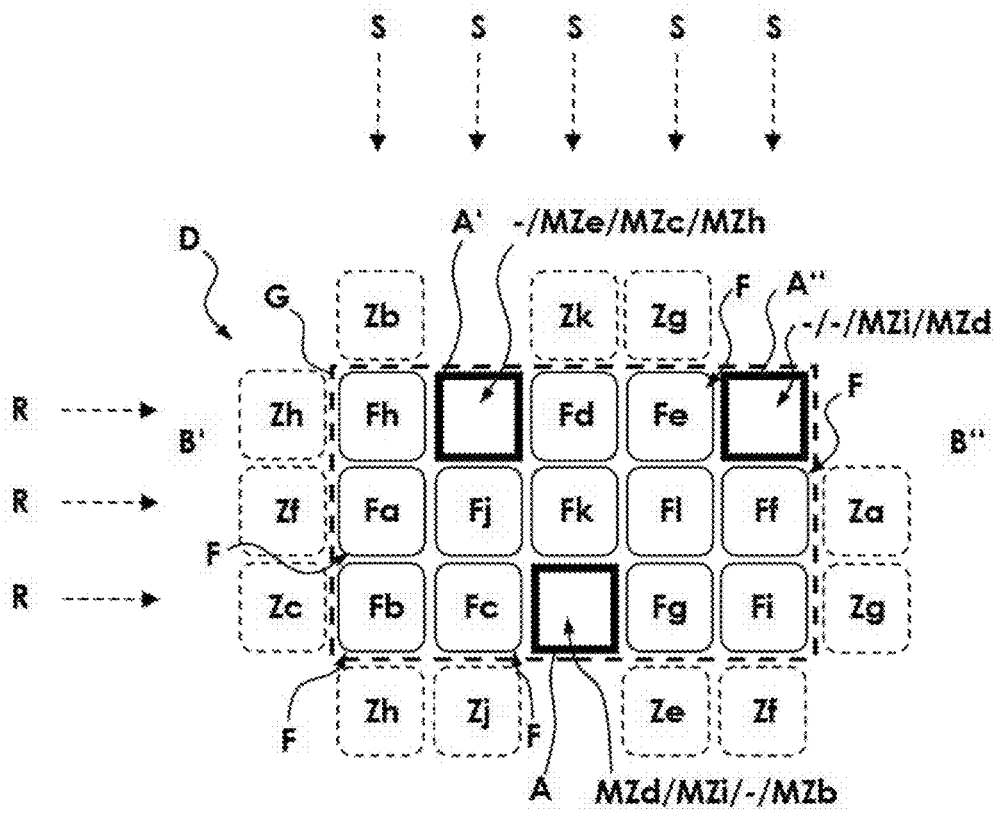
FIG. 1 is a schematic representation of an initial configuration of depicted fragments and their twin and multiple twin fragments within a grid on a display.

FIG. 1 shows, using an exemplary configuration, a method for changing a visual depiction D composed of fragments Fa-Fl of the same or unequal size. The fragments Fa-Fl include content that is visually perceptible to the user and depicted on a display. The depiction D is divided into a user-visible grid G with cells F on the display, which is formed from rows R arranged one above the other and columns S arranged next to one another. The method contains instructions which carry out the following steps:

a) displaying on the display an initial configuration of the fragments Fa-Fl within the grid G;

b) detecting an input made by the user regarding a fragment (Fa-Fl) to be moved, wherein in response to detecting the input, the selected fragment (Fa-Fl) is moved to a different position within the grid (G) on a cell (F) of the display. The input can be detected, for example, via a touch-sensitive surface of the relevant display (e.g. on a tablet, a smartphone or other mobile device). Likewise, it is possible to detect the input using other suitable sensors such as a touchpad, a keyboard or computer mouse, speech recognition, eye tracking or alternative input devices;

c) by moving a user-selected fragment Fa-Fl in a row R or column S, all fragments Fa-Fl adjacent to this user-selected fragment Fa-Fl in this row R or column S affected by the movement of the user-selected fragment Fa-Fl moved by the user are also moved. This sequence of movements of the fragments Fa-Fl adjacent (to the user-selected fragment Fa-Fl moved directly by the user) is referred to below as "indirect movement;"

d) within at least one row R and column S of the grid G on the display, at least one gap A, A', A" is formed, which does not represent a cell F and in which no fragment Fa-Fl is depicted and which cannot be moved directly or indirectly by an input of the user;

e) at least one fragment Fa within a row R or column S of the grid G directly adjacent to an outer area B 'of the grid G-if present-is assigned a twin fragment Za in an opposite outer area B" of the grid G opposite this first outer area B' in the same row R or column S. The twin fragment Za corresponds to the content displayed by the displayed fragment Fa and is not visible to the user in the form of a clipboard in which the data of the content of this fragment Fa are temporarily stored, and f) at least one fragment Fb within a row R or column S of the grid G directly adjacent to an outer area B'—if present—is assigned a multiple twin fragment MZb within the gap A adjacent in the relevant row R or column S. A content of the multiple twin fragment MZb corresponds to the content indicated by the visible fragment Fb. The multiple twin fragment MZb is not visible to the user and is in the form of a clipboard in which the data of the contents of this fragment Fb are buffered, and g) at least one fragment Fc directly adjacent to a gap A within a row R or column S of the grid G—if present—is assigned a twin fragment Ze in an outer area B' of the grid G opposite this gap A from the perspective of the relevant fragment Fc in the same row R or column S. The twin fragment Zc corresponds to the content displayed by the displayed fragment Fc and is not visible to the user. The twin fragment Zc is a clipboard in which the data of the content of this fragment Fc are temporarily stored, and h) at least one fragment Fd directly adjacent to a gap A' within a row R or column S of the grid G—if present—is assigned a multiple twin fragment MZd in a further gap A" opposite this gap A' from the perspective of the relevant fragment Fd in the same row R or column S. The multiple twin fragment MZd corresponds to the content displayed by the displayed fragment Fd and is not visible to the user. The multiple twin fragment MZd is in the form of a clipboard in which the data of the content of this fragment Fd are temporarily stored.

In the context of the present application, "if present" means that initially only those (preferably movable) fragments Fa-Fl are assigned a twin fragment Za-Zc, Ze-Zh, Zj, Zk or multiple twin fragment MZa-MZe, MZh, MZi, which actually border an outer area B', B" or a gap A, A', A" within the relevant row. If, for example, the software prevents a single fragment Fa-Fl from moving in a row and/or in a column, i.e. this fragment Fa-Fl is blocked, a software-side assignment of a twin Za-Zc, Ze-Zh, Zj, Zk or a multiple twin fragment MZa-MZe, MZh, MZi should preferably be excluded.

A further procedural instruction provides that a direct or indirect movement of a fragment Fa-Fi towards the outer area B', B" of the grid G or towards a gap A, A', A" causes the contents of this fragment Fa-Fi to be displayed by a corresponding shift of the content of its cached, previously invisible, twin fragment Za-Zc, Ze-Zh, Zj, Zk or multiple twin fragment MZa-MZe, MZh, MZi into a defined cell F.

This defined cell F is arranged within the same row R or column S affected by the movement of the fragment Fa-Fi moved by the user.

Furthermore, viewed in the opposite direction of movement, this cell F borders directly on the nearest gap A, A', A" or on the nearest outer area B', B" on the side of the adjacent, moving fragments Fa-Fi. In this context, "lying on its side" means a field F which, with regard to a directly adjacent gap A, A', A", is arranged on the same side on which the fragment Fa-Fi in question is to be moved is arranged.

Ultimately, the method provides that a movement of the adjacent fragments Fb-Fc; Fd-Fe on one side of a gap causes no movement of any fragments Fg, Fh, Fi located on the opposite side of the gap. That is, a movement of fragments on the left side of a gap causes no movement of fragments on the right side of the gap, and vice versa. A movement of fragments above a gap causes no movement of fragments below the gap, and vice-versa.

A further exemplary embodiment provides that if, viewed in the direction of movement of a fragment Fh, there is only exactly one field F within a row R or column S between an outer area B 'and a gap A', then exactly one field F, in which the content of the twin fragment Zh or the multiple twin fragment MZh is displayed after the movement of a fragment Fh, corresponds to the field F of the moved fragment Fh and/or if, viewed in the direction of movement of a fragment, there is only exactly one field F within a row R or column S located between a first gap and a second gap, the exactly one field F in which the content of the first multiple twin fragment of the first gap or the content of the second multiple twin fragment of the second gap is displayed after the movement of a fragment, corresponds to the field F of the moving fragment.

In a further advantageous embodiment, outside the grid G, several fragments Fa-Fl lying next to one another in the same row R or column S can contain invisible twin fragments Za-Zc, Ze-Zh, Zj, Zk, whereby the order of arrangement of the twin fragments Za-Zc, Ze-Zh, Zj, Zk corresponds to the order and arrangement of the corresponding fragments Fa-Fl.

Figure 2A:
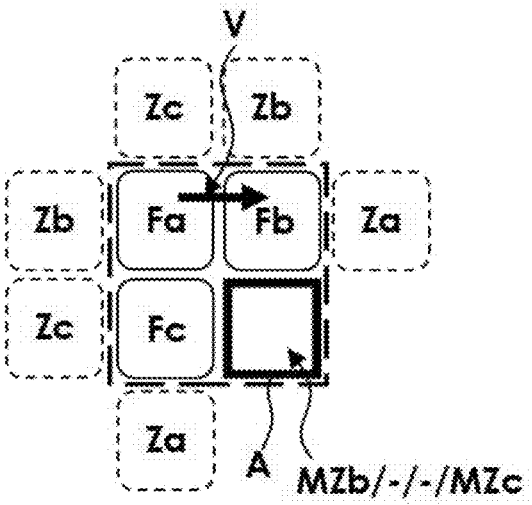
FIG. 2*a* shows an exemplary embodiment with the depiction of a shift V of the fragment Fa to the right by the user.
Figure 2B:
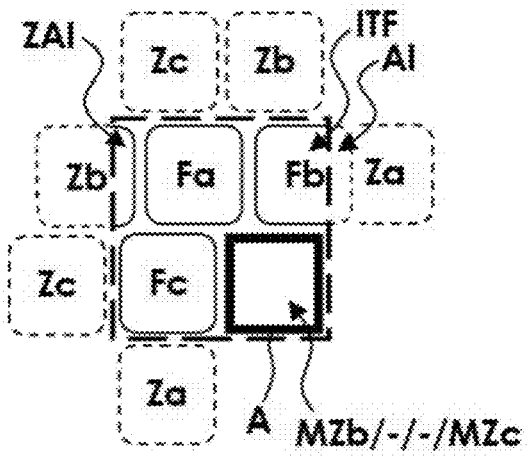
FIG. 2*b* shows a snapshot of the gradual shift V of the fragment Fa to the right, with the fragments Fb lying next to Fa and the twin fragment Zb being moved along with it.
Figure 2C:
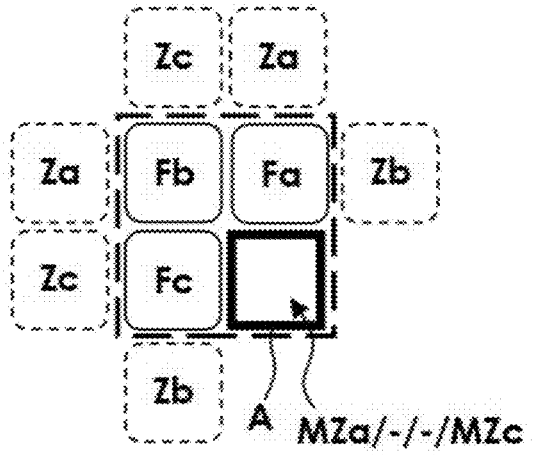
FIG. 2*c* shows a software-based update of the twin fragments after the shift, where Zb becomes Fb within the grid and the twin fragments Za, Zb are re-positioned.

Furthermore, the method preferably provides that at least one twin fragment Za-Zc, Ze-Zh, Zj, Zk and/or at least one multiple twin fragment MZa-MZe, MZh, MZi is assigned updated content of its newly associated fragment Fa-Fl during or after a movement of the associated fragment Fa-Fl (see FIG. 2*c*).

FIG. 2*b* shows that the fragments Fa-Fl and/or the twin fragments Za-Zc, Ze-Zh, Zj, Zk or the multiple twin fragments MZa-MZe, MZh, MZi can be gradually shifted, for example gradually shifted by one or more pixels of its displayed content. A gradual shift of fragment Fa-Fl moved by the user Fa-Fl at the same time effects a gradual shift of adjacent fragments Fa-Fl as well as the corresponding twin Za-Zc, Ze-Zh, Zj, Zk or multiple twin fragments MZa-MZe, MZh, MZi to be moved.

A further aspect provides that the content part of the content of a moving fragment Fa-Fl that is still within a moving fragment Fa-Fl during the gradual shift is displayed visibly shifted in the respective field F, while during the gradual shift in a gap A, A', A" or the content part of a moving fragment Fa-Fl that is shifted into the outer area B', B" is displayed invisibly and that from a gap A, A', A" or the outer area B', B" pushed out content part ZAI of a twin fragment Za-Zc, Ze-Zh, Zj, Zk or multiple twin fragment MZa-MZe, MZh, MZi is visibly displayed.

In a further embodiment, the fragments Fa-Fl are randomly arranged in their initial configuration, i.e., before the user shifts a fragment Fa-Fl for the first time.

FIGS. 3-12 show various permutations of fragments Fa-Fl after a selected fragment has been moved from the initial configuration of the fragments Fa-Fl shown in FIG. 1.

Figure 3:
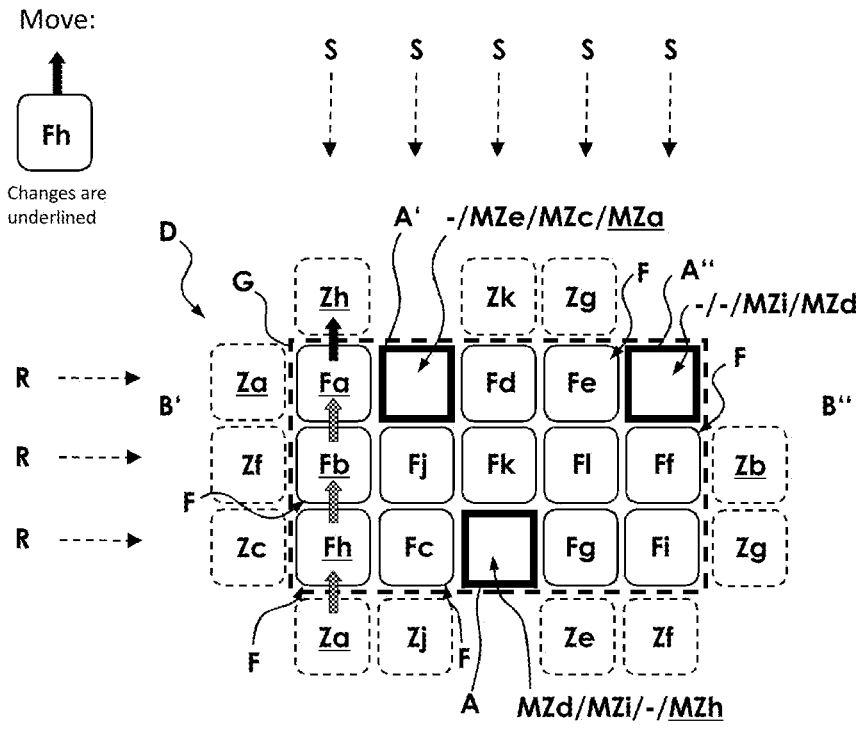
FIGS. 3-12 show states of the grid as in FIG. 1 after movement of various selected fragments.

FIG. 3 shows the configuration of the grid after the fragments in the leftmost column S have moved upward. The fragment Fh in the top left position of FIG. 1 has moved upward out of the visible grid G. The fragment Fa in the center row R has moved up into the upper left corner. Fragment Fb has moved upward from the lower left corner into the center row. The top-left fragment Fh had previously been assigned an invisible twin fragment Zh in a lower outer area below the bottom-left fragment Fb. The previously invisible twin fragment Zh served as a clipboard for the content of fragment Fh in the top-left corner. After the upward shift, the previously invisible twin fragment Zh is now visible in the left-bottom corner of the grid. In effect, the left-top fragment Fh has rolled over into the left-bottom corner by virtue of its invisible twin.

Figure 4:
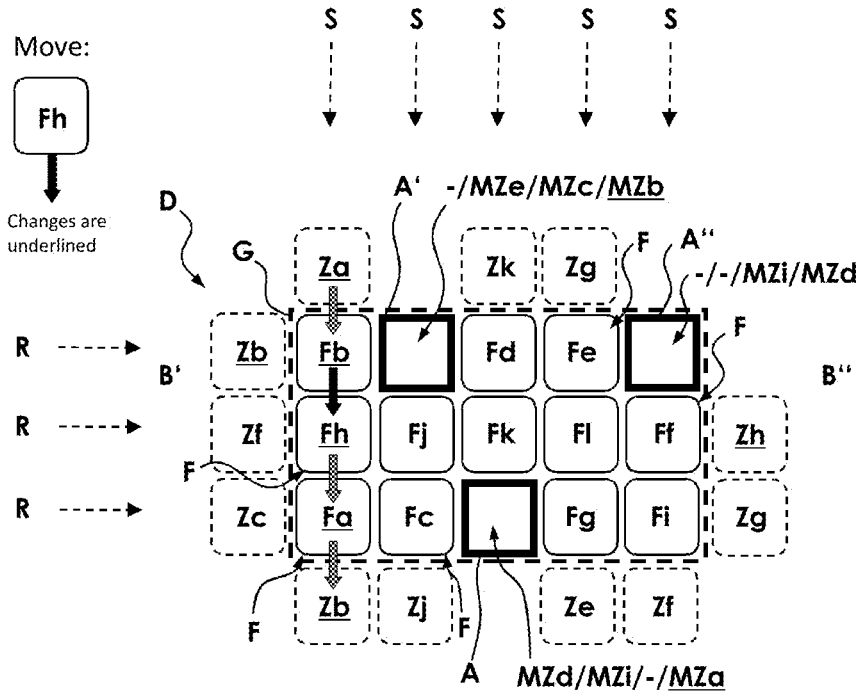

FIG. 4 shows the configuration of the grid after the fragments in the leftmost column S have moved downward. Here, the left-bottom fragment Fb has rolled over into the top-left position, in form of a corresponding movement of the previously invisible twin fragment Zb that was shown above the top-left fragment Fh in FIG. 1.

Figure 5:
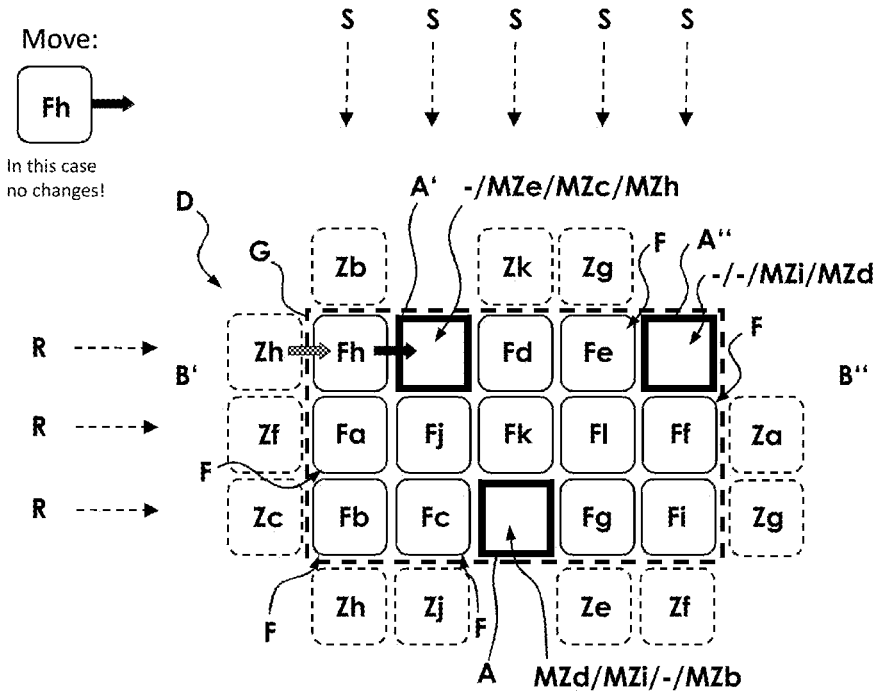

FIG. 5 shows the configuration of the grid after the left-top fragment Fh has moved to the right into the gap A'. Its content has been replaced by its own twin fragment Zh. In effect, the left-top fragment Fh has rolled over into the gap and replaced itself. Fragments on the right side of the gap A' are not affected by the horizontal movement of fragments on the left side of the gap A'.

Figure 6:
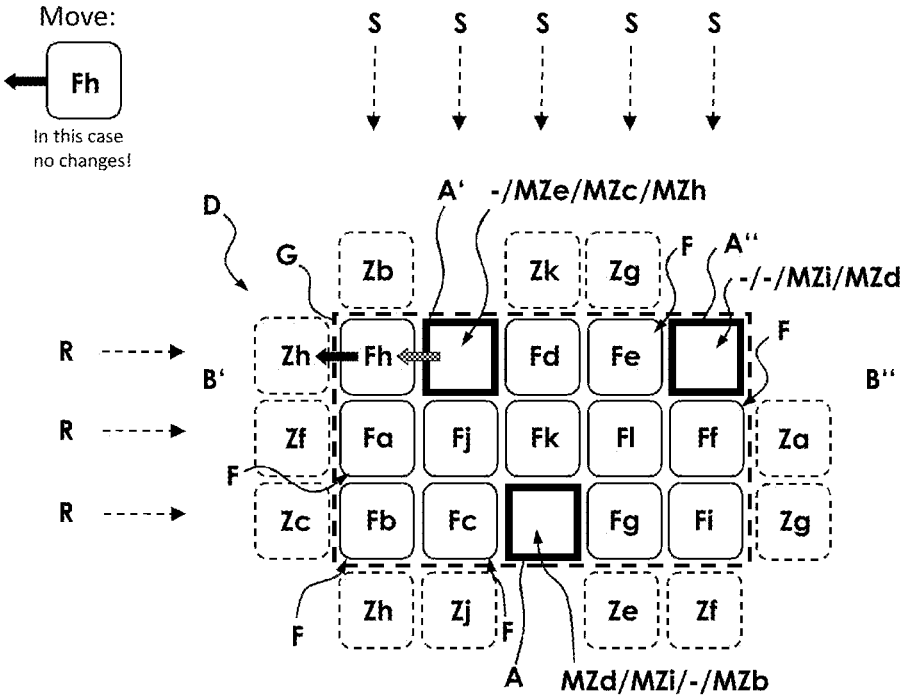

FIG. 6 shows the configuration of the grid after the left-top fragment Fh has moved to the left into the left outer area B'. Its content has been replaced by its own twin fragment MZh that was previously assigned to the gap A'. In effect, the left-top fragment Fh has rolled over into the outer area and replaced itself out of the gap A'.

Figure 7:
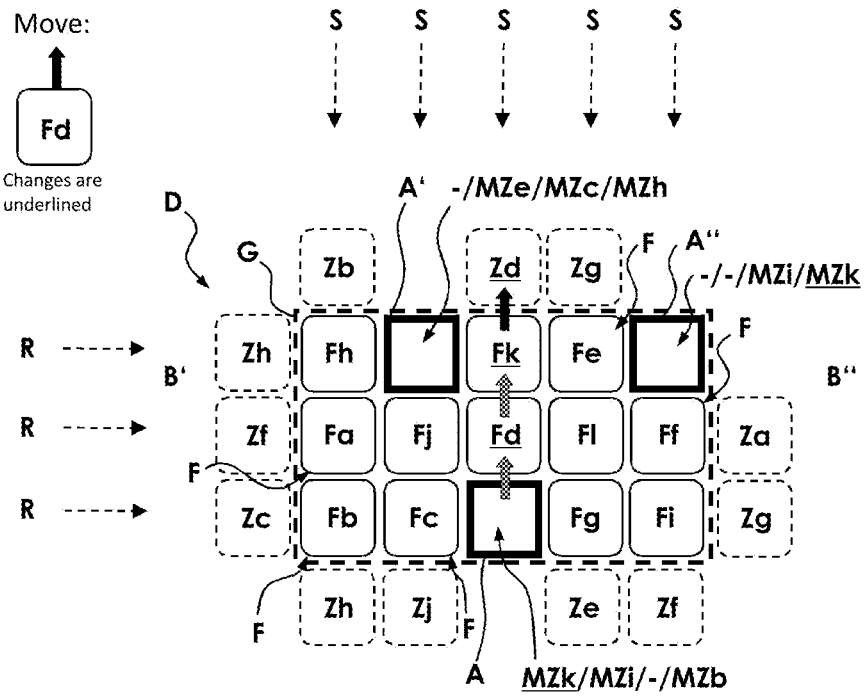

FIG. 7 shows the configuration of the grid after the fragments in the center column S have moved up. Here, the top row fragment Fd has effectively rolled over out of the gap A to take the place of the center row fragment Fk, which is now in the top row.

Figure 8:
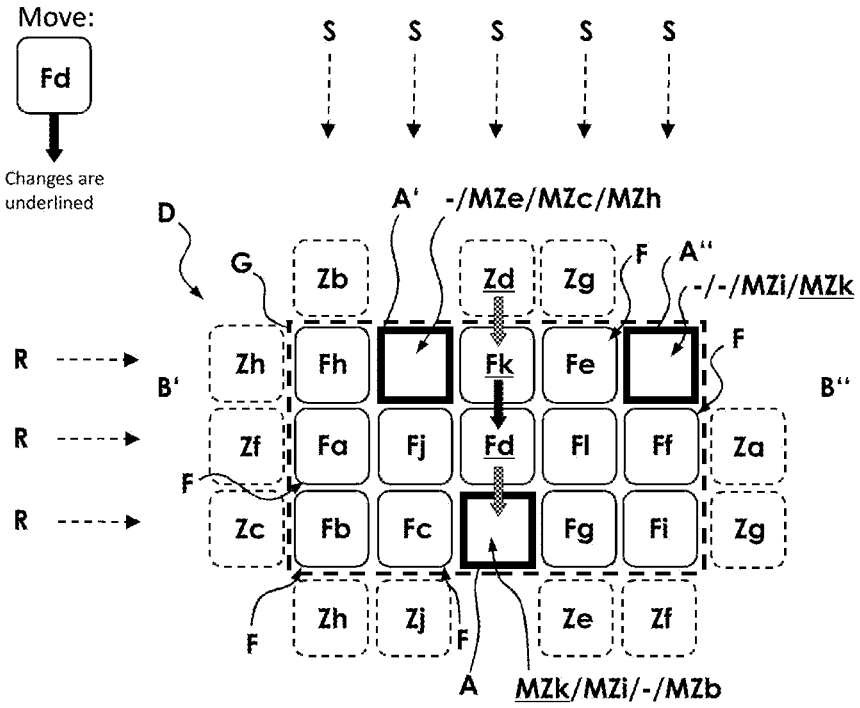

FIG. 8 shows the configuration of the grid after the fragments in the center column S have moved down. Here, the center row fragment Fk has effectively rolled over into the top row position.

Figure 9:
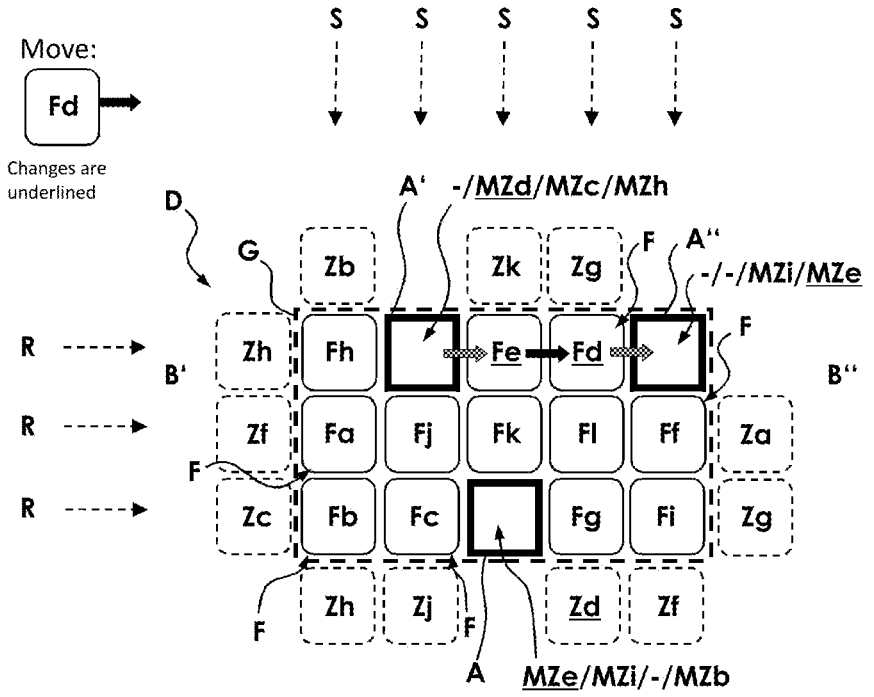

FIG. 9 shows the configuration of the grid after the fragments between two gaps A' and A" in the top row have moved to the right. Fragments Fd and Fe have effectively switched positions, without affecting the left-top fragment Fh in the same row on the left side of the gap A'. In effect, fragment Fd has been replaced by Fe's multiple twin MZe.

Figure 10:
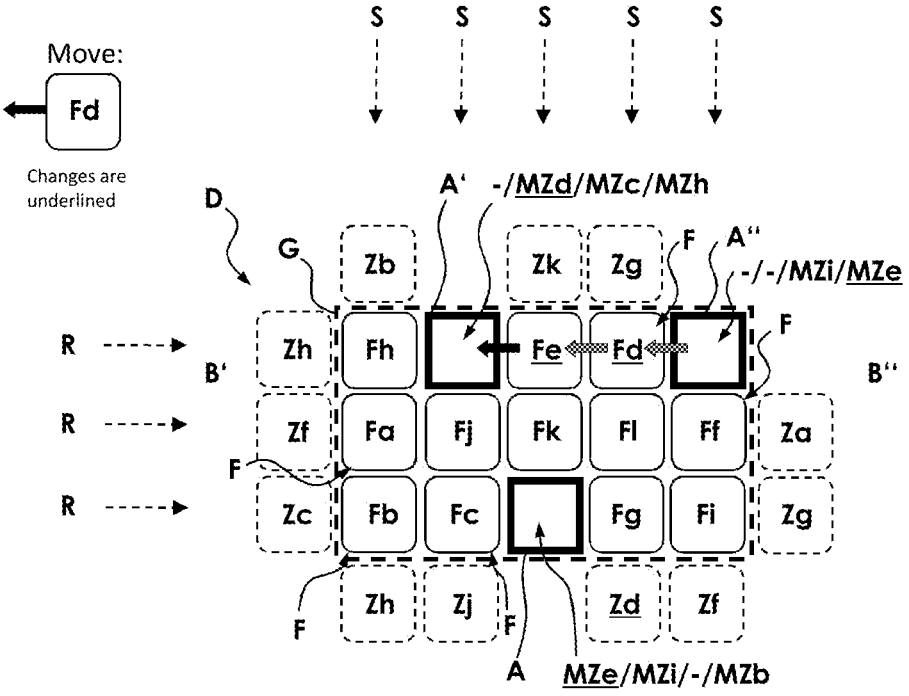

FIG. 10 shows the configuration of the grid after the fragments between two gaps A' and A" in the top row have moved to the left. Again, Fe and Fd have changed positions. Fd has effectively rolled over out of the right gap A" by its multiple twin MZd.

Figure 11:
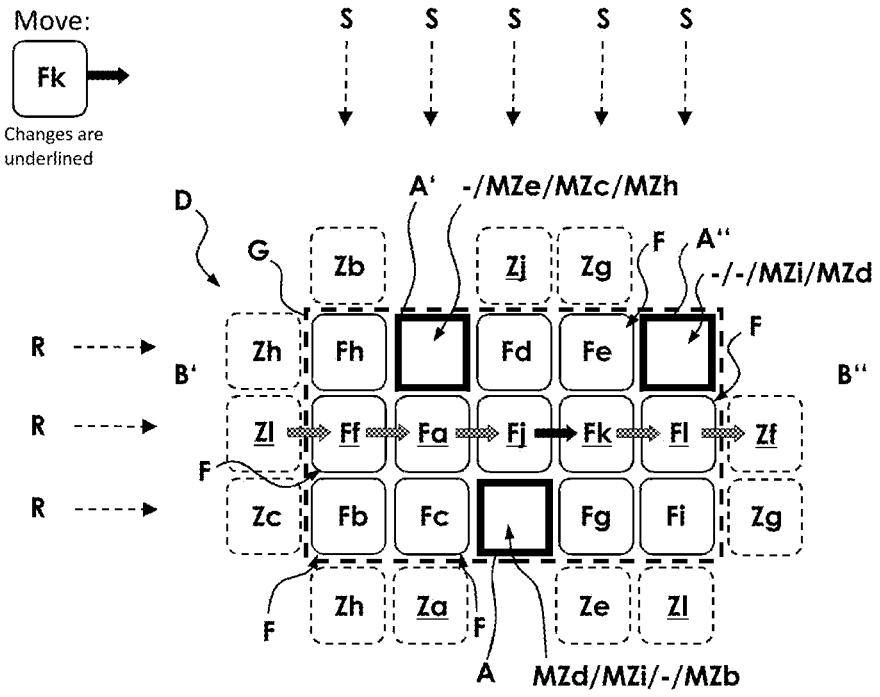
Figure 12:
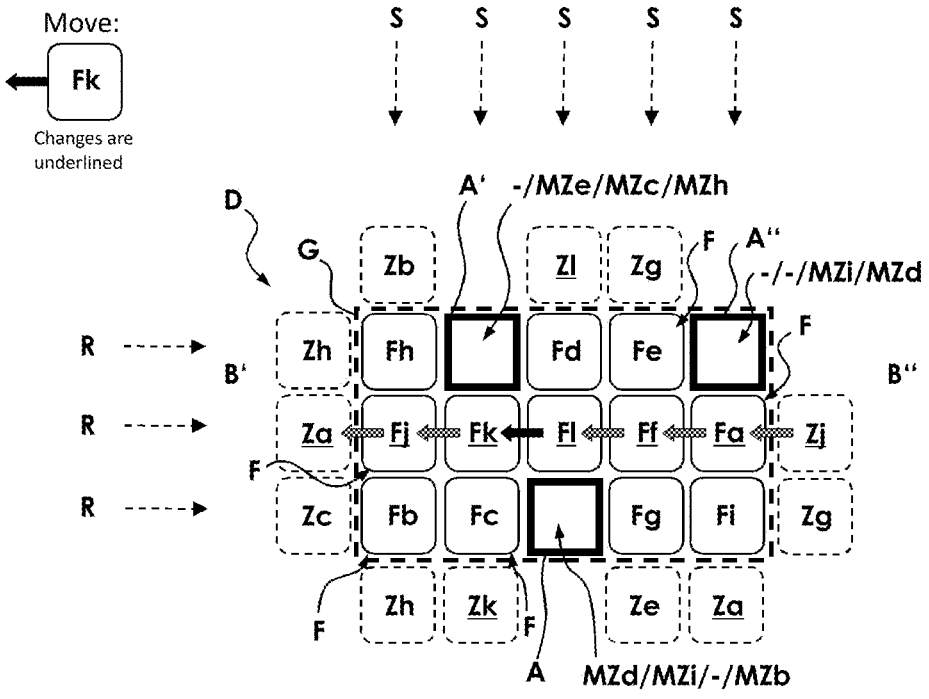

FIGS. 11 and 12 show horizontal movement of all fragments Fa, Fj, Fk, Fl, and Ff in the center row. During right movement, the fragment Ff in the rightmost column rolls over into the leftmost column. During left movement, the fragment Fa in the leftmost column rolls over into the rightmost column.

LIST OF REFERENCE NUMBERS

A', A", A" gaps
AI moved content part
B', B" outer area
D depiction on a display of a screen
F cells
Fa-Fl visible fragments within the grid
G grid
ITF content part
MZa-MZe, MZh, MZi multiple-twin fragments
R rows
S columns
V shift by the user
Za-Zc, Ze-Zh, Zj, Zk twin fragments
ZAI pushed out content part

What is claimed is:

1. A method for changing a visual depiction (D) composed of fragments (Fa-Fl), wherein the fragments (Fa-Fl) have contents that is visually perceptible to a user on a display, and wherein the fragments (Fa-Fl) are arranged in cells (F) within a visible grid (G) on the display, the grid being formed by rows (R) arranged one above another and columns(S) arranged next to one another, wherein at least one gap (A, A', A") is arranged within the visible grid (G), wherein the at least one gap (A, A', A") does not represent a cell (F), wherein no fragment (Fa-Fl) is depicted within the at least one gap (A, A', A"), and wherein the at least one gap (A, A', A") cannot be moved directly or indirectly by a user input, the method comprising:

displaying on the display an initial configuration of the fragments (Fa-Fl) within the grid (G);

detecting a user input with regard to a selected fragment (Fa-Fl) of the fragments (Fa-Fl) to be moved;

in response to detecting the user input, moving the selected fragment (Fa-Fl) to a different position within the grid (G) on a cell (F) of the display;

jointly moving all of the fragments (Fa-Fl) adjacent to the selected fragment (Fa-Fl) within the row (R) or the column(S) of the selected fragment (Fa-Fl);

assigning an invisible twin fragment (Za) to at least one first outer fragment (Fa) within a row (R) or a column(S) of the grid (G) directly adjacent to a first outer area (B') of the grid (G), if present, wherein the invisible twin fragment (Za) is arranged in a second outer area (B") of the grid (G) opposite the first outer area (B') in the same row (R) or column(S) as the at least one outer fragment (Fa), and wherein the invisible twin fragment (Za) serves as a clipboard in which data of the content of the at least one first outer fragment (Fa) are temporarily stored;

assigning an invisible multiple-twin fragment (MZb) to at least one second outer fragment (Fb) within a row (R) or a column(S) of the grid (G) directly adjacent to the first outer area (B') of the grid (G), if present, wherein the invisible multiple-twin fragment (MZb) is arranged in the gap (A) of the grid (G) in the same row (R) or column(S) as the at least one second outer fragment (Fb), and wherein the invisible multiple-twin fragment (MZb) serves as a clipboard in which data of the content of the at least one second outer fragment (Fb) are temporarily stored;

assigning an invisible second twin fragment (Zc) to at least one first gap-adjacent fragment (Fc) within a row (R) or a column(S) of the grid (G) directly adjacent to the gap (A) of the grid (G), if present, wherein the invisible second twin fragment (Zc) is arranged in an outer area (B') of the grid (G) opposite the gap (A) from the viewpoint of the at least one first gap-adjacent fragment (Fc) in the same row (R) or column(S) as the at least one first gap-adjacent fragment (Fc), and wherein the invisible second twin fragment (Zc) serves as a clipboard in which data of the content of the at least one first gap-adjacent fragment (Fc) are temporarily stored;

assigning an invisible second multiple-twin fragment (MZd) to at least one second gap-adjacent fragment (Fd) within a row (R) or a column(S) of the grid (G) directly adjacent to a further one of the gaps (A') of the grid (G), if present, wherein the invisible second multiple-twin fragment (MZd) is arranged in a further gap (A") opposite the gap (A') from the viewpoint of the at least one second gap-adjacent fragment (Fd) in the same row (R) or column(S) as the at least one second gap-adjacent fragment (Fd), and wherein the invisible second multiple-twin fragment (MZd) serves as a clipboard in which data of the content of the at least one second gap-adjacent fragment (Fd) are temporarily stored; and causing, based on a direct or indirect movement of a fragment (Fa-Fi) towards the outside area (B', B") of the grid (G) or towards a gap (A, A', A"), the contents of a fragment (Fa-Fi) to be displayed by a corresponding shift of the content of its twin fragment (Za-Zc, Ze-Zh, Zj, Zk) or multiple twin fragment (MZa-MZe, MZh, MZi) in a cell (F), which is arranged within the row (R) or column(S) affected by the movement of the fragment (Fa-Fi) moved by the user and which, viewed in the opposite direction of movement, is directly adjacent to the nearest gap (A, A', A") or to the nearest outer area (B', B") on the side of the moving adjacent fragments (Fa-Fi), wherein a movement of the adjacent fragments (Fb-Fc; Fd-Fe) does not cause any movement of any fragments (Fg, Fi; Fh) on the other side of the nearest gap (A, A').

2. The method according to claim 1, wherein, if, viewed in the direction of movement of a fragment (Fh), there is only exactly one field (F) within a row (R) or column(S) between an outer area (B') and a gap (A'), then the exactly one field (F), in which the content of the twin fragment (Zh) or the multiple twin fragment (MZh) of the gap (A) is displayed after the movement of a fragment (Fh), corresponds to the field (F) of the moved fragment (Fh), and/or if, viewed in the direction of movement of a fragment, there is only exactly one field (F) within a row (R) or column(S) between a first gap and a second gap, exactly one field (F) in which the content of the first multiple twin fragment of the first gap or the content of the second multiple twin fragment of the second gap is displayed after the movement of a fragment corresponds to the field (F) of the moved fragment.

3. The method according to claim 1, wherein a content of at least one twin fragment (Za-Zc, Ze-Zh, Zj, Zk) and/or at least one multiple twin fragment (MZa-MZe, MZh, MZi) is updated during or after a movement of an assigned fragment (Fa-Fl).

4. The method according to claim 1, wherein the fragments (Fa-Fl) and/or the contents of the twin fragments (Za-Zc, Ze-Zh, Zj, Zk) or the contents of the multiple twin fragments (MZa-MZe, MZh, MZi) are gradually shifted during a movement, wherein the content part (ITF) of the content of a moved fragment (Fa-Fl) that is still within a moving fragment (Fa-Fl) during the gradual shift is shown visibly shifted in the respective field (F), and wherein, during the gradual shift of a moving fragment (Fa-Fl) into a gap (A) or into the outer area (B), a content part (AI) of the moving fragment (Fa-Fl) that has been moved into the gap (A) or the outer area (B) is displayed invisibly, and a content part (ZAI) that has been pushed out of the gap (A) or the outer area (B) from a twin fragment (Za-Zc, Ze-Zh, Zj, Zk) or multiple twin fragment (MZa-MZe, MZh, MZi) is visible.

* * * * *